US010227206B2

(12) United States Patent
Derrick

(10) Patent No.: US 10,227,206 B2
(45) Date of Patent: Mar. 12, 2019

(54) REMOVABLE WEAR HUBS FOR A SPOOL OR REEL

(71) Applicant: Clinton W Derrick, Hempstead, TX (US)

(72) Inventor: Clinton W Derrick, Hempstead, TX (US)

( * ) Notice: Subject to any disclaimer, the term of this patent is extended or adjusted under 35 U.S.C. 154(b) by 0 days.

(21) Appl. No.: 15/364,025

(22) Filed: Nov. 29, 2016

(65) Prior Publication Data

US 2017/0297856 A1 Oct. 19, 2017

Related U.S. Application Data

(60) Provisional application No. 62/390,986, filed on Apr. 18, 2016.

(51) Int. Cl.

| | |
|---|---|
| ***B65H 75/14*** | (2006.01) |
| ***B65H 75/18*** | (2006.01) |
| ***B65H 75/22*** | (2006.01) |
| ***B65H 75/30*** | (2006.01) |
| ***B65H 75/50*** | (2006.01) |

(52) U.S. Cl.

CPC ..... *B65H 75/30* (2013.01); *B65H 75/14* (2013.01); *B65H 75/185* (2013.01); *B65H 75/22* (2013.01); *B65H 75/505* (2013.01)

(58) Field of Classification Search

CPC .... B65H 75/14; B65H 75/185; B65H 75/187; B65H 75/22; B65H 75/30; B65H 75/505

See application file for complete search history.

(56) References Cited

U.S. PATENT DOCUMENTS

| | | | | |
|---|---|---|---|---|
| 6,527,215 | B1 | 3/2003 | Cain et al. | |
| 2012/0247579 | A1 | 10/2012 | Park | |
| 2016/0039631 | A1 * | 2/2016 | Feffer | B65H 75/30 242/394 |

FOREIGN PATENT DOCUMENTS

| | | | | |
|---|---|---|---|---|
| EP | 1232987 | A1 * | 8/2002 | B65H 75/185 |

* cited by examiner

*Primary Examiner* — William E Dondero

(74) *Attorney, Agent, or Firm* — Jones Walker LLP

(57) ABSTRACT

A spool or reel for carrying spoolable or coilable material comprises first and second sides, a drum disposed there between at least one flange secured to a side and associated with the axis of rotation of the spool. The flange comprises a socket preferably centered about the axis of rotation and configured to receive a replaceable wear hub. The flange and replaceable wear hub are configured to transmit torque there between so that relative rotation between the components is minimized or eliminated.

24 Claims, 7 Drawing Sheets

REMOVABLE WEAR HUBS FOR A SPOOL OR REEL

CROSS REFERENCE TO RELATED APPLICATIONS

This application claims priority to U.S. Provisional patent application Ser. No. 62/390,986, filed Apr. 18, 2016, the contents of which are incorporated herein in their entirety.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The inventions disclosed and taught herein relate generally to spools and reels for carrying flexible tubulars; and more specifically relate to replaceable components in the hubs of spools and reels.

Description of the Related Art

Coiled tubing, line pipe, and wire are essential to several global industries and are used for many purposes. One notable example is in the oil and gas industry where tubing and pipe of this nature are typically transported on a spool and either used directly from the spool, or transferred to a reel for use in wells, for otherwise transporting fluids, or for many other operations. Another notable example is in the power industry, which transports wire bundles on spools and deploys them to convey electricity. Similarly, the telecommunications industry transports wire or fiber optic cables on spools and deploys them to enable communications. Along with many others, each of these industries requires spools and reels of sturdiness and structural endurance for transporting and deploying spoolable or coilable materials. However, as with all durable goods, spools and reels are susceptible to wear and the elements, and must at some point in time be retired or refurbished. And, similar to other durable goods, reels and spools are generally made in a cost-effective manner by constructing them as a single unit using permanent welds. Such construction techniques do not lend themselves well to refurbishment.

In most industries that use them, the terms spool and reel have somewhat distinct meanings. Typically, "spool" is used to refer to the device used to transport the coilable or spoolable material such as flexible tubulars, and "reel" is used to refer to the device from which or to which the material is payed during use. However, since the inventions described herein are applicable to both spools and reels, the distinction may be somewhat moot to this specification and the terms will be used interchangeably.

When a spool or reel is being loaded (where the material is being "payed on"), unloaded (where the material is being "payed off"), or otherwise in use, it may be suspended in a device known as a reel assembly or reel stand. Reel stands and their operations are described in U.S. Pat. No. 6,527,215 and US Patent Application Publication 2012/0247579, which are hereby incorporated by reference in their entirety.

In general terms, an axle may be fitted into a central shaft of a spool or reel, or spindles inserted into each side of the spool or reel, and the unit may be placed onto a cradle which receives the protruding ends of the axle or spindles. Similarly, when a spool or reel is not needed, the spindles or axles may be left in the spool and set on a stand until it is again needed. In some situations when an unloaded spool is not in use the axle or spindles may be removed and the spool set aside so its rims sit on the ground. In some cases, the spool may be turned on its side.

Flanges or hubs are typically disposed on the sides of the spool to transfer the motive forces to the spool or reel. The motive functions of lifting, supporting, and driving the spool or reel are all performed through these flanges. Frequently there is a single hub/flange on each side of the reel or spool and all of the motive forces are applied there. As such the structural members of the spool or reel are usually secured to the hubs/flanges.

When a spool or reel is first placed in use, it may be lifted and mounted onto a reel stand. Lift holes in the hubs are typically used to grasp the spool on each side. In small reels only a single pair of holes may be needed with one hole on each side of the reel being used to lift and maneuver the reel. Larger reels may require additional pairs of holes on each side for sufficient support. Utilizing fewer holes than are sufficient to distribute the weight of the spool or reel can result in damage to the lifting points. This damage to the lifting holes may consist of deformation of the holes from pulling them out of round, or deforming the metal around the holes resulting in a camber to the hole shafts, or both. In extreme cases, the metal around the holes may be rent or split. Also, if the hub is not well secured to the other structural members of the spool or reel when it is being lifted, then it may separate from the other components causing an overall failure of the spool or reel.

Typically, reels and spools have considerable mass due to the materials of construction, and a loaded reel or spool is even more massive. Paying off or paying on material usually requires that the spool or reel be driven to overcome its resting inertia, to keep it rotating, and to stop it, or to change its direction. To accomplish this, a drive motor may be engaged with the hubs of the spool or reel. In many situations, when a reel is needed for use it is mounted in a reel assembly wherein an axle is inserted through the drum, and drive pins connected to the drive motor are inserted into drive pin holes on the hub. When the reel is fully secured into the reel assembly, the drive motor may then exert a force on each of the drive pins, which in turn exerts a force on the drive pin holes resulting in the hub, or drive member, rotating the reel along its axis. Similar to the lifting holes, the drive pin holes should be engaged in sufficient number to properly distribute the load applied, and secured well enough to prevent separation from other structural members. In some cases, the drive motor may be only on one side of the reel so only the drive pin holes on that side are engaged. And again similar to the lifting holes, the drive pin holes are susceptible to damage from inappropriately distributed forces. In some cases, the holes may be enlarged or otherwise damaged because of the varying forces from the drive pins as the spool rotation is continually started, sped up, slowed, stopped, and reversed.

Like the lifting and drive holes, the central axis holes are also susceptible to damage. For example, when a spool is resting in a stand, its own mass pushes against the spindles or axle supporting it with sufficient force to distort the axial sleeve elliptically or ovaloidally. In such cases, the metal around the spindles may yield to the load to form an unwanted camber, or to otherwise distort the hole. These forces may be exacerbated during transportation when a spool or reel is residing in a reel assembly and subjected to the jarring transport conditions from bumps of rail cars or trucks on uneven roads.

Besides damage occurring from active use, the axial sleeve, the drive pin holes, and the lifting holes may be damaged from exposure to the elements such as water, dirt, and grime at any time. These contaminants and abrasives may become lodged in the sleeves and holes and may initiate or propagate corrosion. Also, when an axle or spindle is inserted into an axial sleeve containing these contaminants, the wear of the axle against the axial sleeve may be exacerbated during use resulting in abnormal surface wear such as scoring and abrading. If these erosions are not properly addressed, the spool may perform unfavorably and, if taken to an extreme, may cause permanent damage to the spool or reel through binding or torsional deformation. These conditions may be preempted through the use of materials that would be more resistant to corrosion and abrasion, but the cost of producing the spools or reels may then become prohibitively high to the industry.

Refurbishing a spool or reel to correct wear or corrosion issues is usually not cost effective due to the current fabrication methods of permanently attaching all components together. Correspondingly, replacing an otherwise serviceable spool or reel because of damage or excessive wear of any of its critical components is also not desirable.

Reel assemblies are plentiful and have been in use throughout the world for many years. They are specifically engineered and sized to receive reels and spools of exacting dimensions. Deviating from these dimensions may not be accepted by any industry that has any investment in reels, spools, and reel assemblies. From this, a simplistic mend of a worn or damaged spool or reel of welding a new hub over the existing one may not be a practicable solution. In this vein, the lifting apparatus and drive mechanisms are designed for spool and reel hubs of the current and well-known art with the same existing dimensions. Departing from these standards may render the spool unfit to operate in existing reel assemblies or stands.

The inventions disclosed and taught herein are directed to assemblies and methods to easily and effectively refurbish reels and spools that have service components that have deteriorated due to common maladies of wear and/or exposure to the elements.

BRIEF SUMMARY OF THE INVENTION

As one of many possible brief summaries of the inventions disclosed herein, a spool or reel for coilable or spoolable material is disclosed in which the spool comprises a pair of sides with a drum extending between the sides and centered substantially about an axis of rotation of the spool. Each spool side may comprise a central portion or drive flange, such as a plate, which may be integral with each side or a separate component to each side. Each central portion may comprise an outer surface or face and a hub socket that is preferably centered substantially about the axis of spool rotation. The hub socket has a predetermined shape or periphery shape, such as rectangular, polygonal, splined, circular, or oval to name but a few. The socket preferably has a depth dimension extending from the outer surface inward toward a center of the spool, and preferably, the socket is configured as a cup having a sidewall or sidewalls and a bottom or partial bottom. Each central portion may have a replaceable hub that is configured to support rotation of the spool about the axis of rotation and that is configured to mate with the shape and dimensions of the hub socket so that when the hub is located in the hub socket, the outer hub surface and the outer central portion surface are substantially flush. Of course, while it is desirable in some embodiment for the hub and central portions to be flush, such configuration is not a requirement and the hub surface may be above or below the surface of the central portion.

The central portion or drive flange may comprise a torque transfer structure or an anti-rotation structure that is operable between the replaceable hub and the central portion or spool so that the replaceable hub has little to no rotation relative to the central portion. In some embodiments, the mating shape of socket and the replaceable hub functions as the torque transfer structure. For example, a splined shape is configured to transfer torque and substantially eliminate relative rotation there between. In other embodiments, pins or fasteners, such as bolts and nuts or studs and nuts, can be used as torque transfer structures. A preferred embodiment comprises a non-circular predetermined shape for the socket and replaceable hub and a plurality of threaded fasteners to secure the replaceable hub to the central portion or socket. In this preferred embodiment, the non-circular shape transfers torque between the components and the fasteners secure the components without transferring and appreciable amount of torque. For embodiments in which the predetermined shape does not transfer torque, for example, a circular predetermined shape, the torque transfer or anti-rotation structures may comprise pins or threaded fasteners, or even weldment between the outer surfaces of the replaceable hub and central portion. Additionally or alternately, an interference fit between the replaceable hub and socket can function as either or both of the torque transfer structure and the system that secures the hub in place.

At least one and usually both of the central portions comprise drive portions, such as drive pin holes. The prime mover on the reel or spool stand typically comprises drive pins that interface with the drive pin holes in the central portion to transmit torque to the spool to generated rotation of the spool (and spooled material) about the spool axis. Certain embodiments may comprise replaceable hubs that also have one or more drive pin holes. Thus, if the drive pin holes become worn or otherwise damaged, the hub can be replaced to provide a new hub and drive holes. Alternately, the socket and hub relationship described above can be use on other portions of the central portion for the drive pin components. In other words, replaceable drive pin components comprising a socket and a replaceable hub can be employed along with the replaceable hub described above. For this type of embodiment, individual worn or damaged components can be replaced as desired.

This brief summary of the inventions is not provided to limit or otherwise affect the scope of the disclosure provided herein or the appended claims, and nothing stated in this Brief Summary of the Invention is intended as a definition of a claim term or phrase or as a disavowal or disclaimer of claim scope.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed description of specific embodiments presented herein.

Figure 1B:
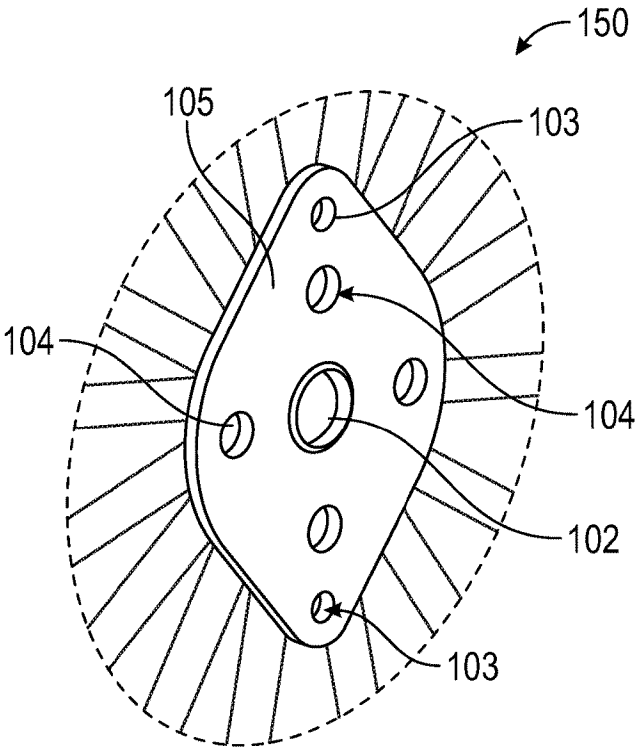
FIG. 1B (Prior Art)
FIG. 1B illustrates certain details of the hub of the spool in FIG. 1A.

While the inventions disclosed herein are susceptible to various modifications and alternative forms, only a few specific embodiments have been shown by way of example in the drawings and are described in detail below. The figures and detailed descriptions of these specific embodiments are not intended to limit the breadth or scope of the inventive concepts or the appended claims in any manner. Rather, the figures and detailed written descriptions are provided to illustrate the inventive concepts to a person of ordinary skill in the art and to enable such person to make and use the inventive concepts.

DETAILED DESCRIPTION

The Figures described above and the written description of specific structures and functions below are not presented to limit the scope of what I have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

I have created apparatuses and methods of replacing the components of spools and reels that are most susceptible to wear and damage with replaceable components. A spool or reel for coilable or spoolable material in which the spool comprises a pair of sides with a drum extending between the sides and centered substantially about an axis of rotation of the spool. Each spool side may comprise a central portion or drive flange, such as a plate, which may be integral with each side or as separate component to each side. Each central portion may comprise an outer surface or face and a hub socket that is preferably centered substantially about the axis of spool rotation. The hub socket has a predetermined shape, such as rectangular, polygonal, splined, circular, or oval to name but a few. The socket preferably has a depth dimension extending from the outer surface inward toward a center of the spool, and preferably, the socket is configured as a cup having a sidewall or sidewalls and a bottom. Each central portion has a replaceable hub that is configured to support rotation of the spool about the axis of rotation and that is configured to mate with the shape and dimensions of the hub socket so that when the hub is located in the hub socket, the outer hub surface and the outer central portion surface are substantially flush. Of course, while it is desirable in some embodiment for the hub and central portions to be flush, such configuration is not a requirement and the hub surface may be above or below the surface of the central portion.

The central portion or drive flange may comprise a torque transfer structure that is operable between the replaceable hub and the central portion or spool so that the replaceable hub has little to no rotation relative to the central portion. In some embodiments, the mating shape of the socket and the replaceable hub functions as the torque transfer structure. For example, a splined shape is configured to transfer torque and substantially eliminate relative rotation there between. In other embodiments, pins or fasteners, such as bolts and nuts or studs and nuts, can be used as torque transfer structures. A preferred embodiment comprises a non-circular predetermined shape for the socket and replaceable hub and a plurality of threaded fasteners to secure the replaceable hub to the central portion or socket. In this preferred embodiment, the non-circular shape transfers torque between the components and the fasteners secure the components without transferring an appreciable amount of torque. For embodiments that have a circular predetermined shape for the socket, the torque transfer structures may comprise pins or threaded fasteners, or even weldment between the outer surfaces of the replaceable hub and central portion. Additionally or alternately, an interference fit between the replaceable hub and socket can function as either or both of the torque transfer structure and the system that secures the hub in place.

At least one and usually both of the central portions comprise drive portions, such as drive pin holes. The prime mover on the reel or spool stand typically comprises drive pins that interface with the drive pin holes in the central portion to transmit torque to the spool to generate rotation of the spool (and spooled material) about the spool axis. Certain embodiments may comprise replaceable hubs that also have one or more drive pin holes. Thus, if the drive pin holes become worn or otherwise damage, the hub can be replaced to provide a new hub and drive holes. Alternately, the socket and hub relationship described above can be used on other portions of the central portion for the drive pin components. In other words, replaceable drive pin components comprising a socket and a replaceable hub can be employed along with the replaceable hub described above. For this type of embodiment, individual worn or damaged components can be replaced as desired.

Figure 1A:
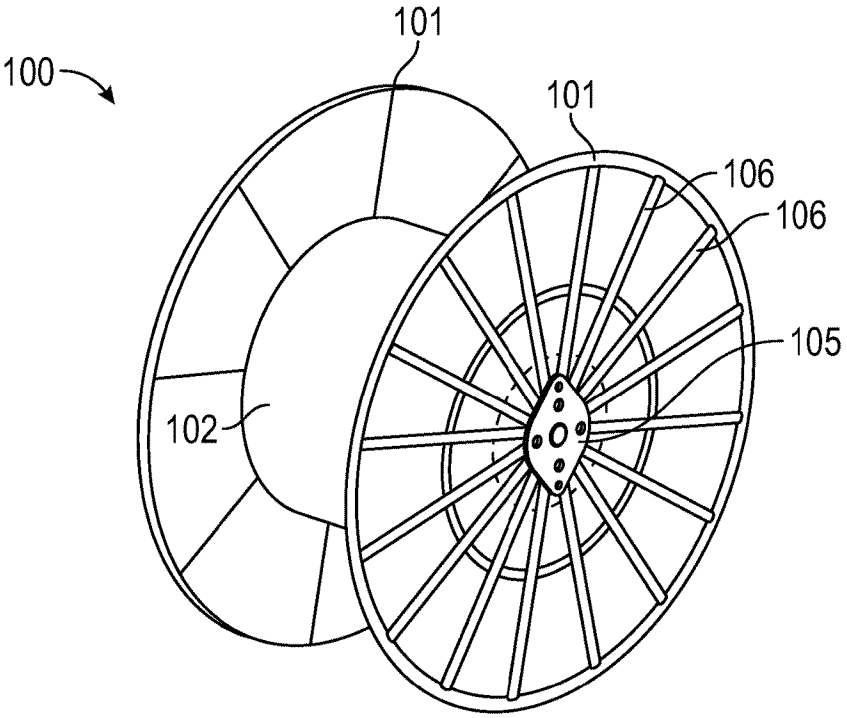
FIG. 1A (Prior Art)
FIG. 1A illustrates at a high level a typical prior art spool.

Turning now to the figures, FIG. 1A is an illustrative spool for coiled tubing, line pipe, wire or wire bundles, other flexible tubulars, or any similar spoolable or coilable material. This figure shows a typical construction of a spool 100 utilizing sides that may comprise rims 101, support members 106 radiating from the central axis, a drum 102, and a central portion or drive flange 105 overlapping the convergence of the radial support members. There is a corresponding central portion or drive flange on the other side of the spool. These components have typically been secured together, such as by welding or threaded fasteners, to make the spool as sturdy and durable as possible. While the figure attempts to illustrate a spool or reel common in the art, there are many variations of construction techniques and materials. One such example is in the support members 106, which may be tubular, angular, or of another form such as radially corrugated metal forming supports.

The detailed view of the central portion or drive flange 105 depicted in FIG. 1B shows elements of the drive flange 105. A central hole in the drive flange 105 provides an opening for a tubular axial sleeve 102, which may or may not connect to the drive flange on the other side of the spool. The inner surface of the axial sleeve typically provides a bearing or sliding surface about which the spool rotates relative to the reel stand (not shown). At a radial distance from the central axis are drive pin holes 104 which provide a point or points to engage or secure drive pins from a reel stand. To match and work with existing reel assembly designs there may be typically two or more of these holes in each drive flange 105. Radially outward from the drive pin holes 104 are lift holes 103, which provide anchor points for attaching to a hoist or crane. While this figure depicts a drive flange 105 of a generally rhombus shape, other shapes have been used, such as square and circular. In this depiction, the central portion or drive flange 105 may be considered to be the nexus for the transfer of all motive forces to the spool or reel, and therefore regarded as a drive member or drive plate.

Figure 2A:
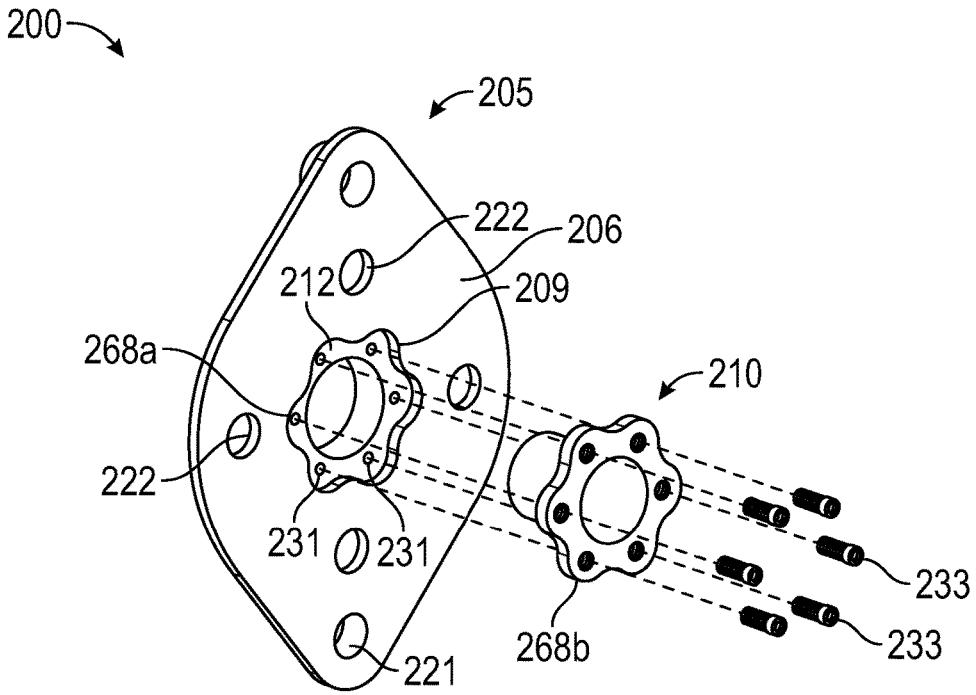
FIG. 2A illustrates an exploded view of an exemplary wear hub insertable into an exemplary hub flange in accordance with certain teachings set forth herein.
Figure 2B:
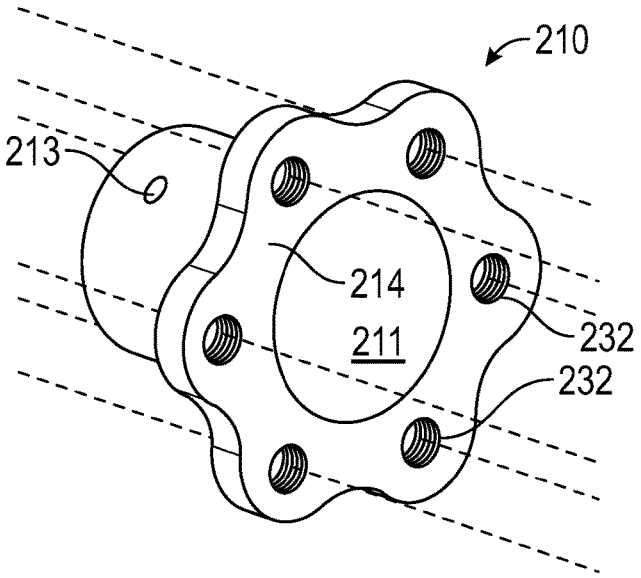
FIG. 2B illustrates a detailed view of an exemplary removable wear hub in accordance with certain teachings set forth herein.

One of many exemplary depictions of the inventions set forth herein is illustrated in FIG. 2A and FIG. 2B showing a spool drive flange assembly 200 comprising a removable wear hub 210 and a wear hub socket 209. As illustrated, the socket 209 and wear hub 210 have a corresponding, predetermined shape. In this exemplary embodiment, the removable wear hub 210 comprises a tubular member or sleeve and a wear hub face plate 214. In this embodiment the outer edge of the wear hub 214 has a predetermined shape, such as a spline, that may be centered about the central axis. The tubular member of the removable wear hub 210 has an inner surface that is the axial sleeve 211 and an outer surface which is the axial sleeve collar 213.

In this embodiment, the drive flange socket 209 comprises a side wall and a bottom surface 212. The bottom surface may comprise one or more threaded holes configured to receive a threaded fastener, such as a bolt or stud. In this type of embodiment, bottom surface 212 may function as a threaded nut. Alternately, the bottom surface or nut 212 may be a separate component from the flange 205 and socket 209. Such nut 212 may be secured, if desired, in any of a number of ways to the back of drive flange 205. As noted before, the drive flange 205 should be sufficiently secured to the structure of the reel or spool to transfer the motive forces. A notable feature of drive flange 205 is the socket portion 209, which allow a fit of the predetermined shape of the wear hub 210 with the socket 209 when the axial sleeve collar 213 is inserted through the nut 212.

In the embodiment depicted in FIG. 2A the exposed surface of the wear hub face plate 214 may be flush with the exposed surface of the drive flange 205 when the removable wear hub 210 is installed. This may be desirable since current spool and reel hubs are substantially flush in the overall side plane. Having a portion of a drive flange overhang the overall plane of a reel or spool may interfere with existing operations of reel assemblies in use throughout industries around the world. Nonetheless, it may be desirable in some circumstances to have a portion of the wear hub extend outwards from the drive flange beyond the plane of a side of the reel. The inventions taught herein are amenable to that concept in that a removable wear hub may be made of different thicknesses but still be insertable into drive flanges having the same outline.

In another envisioned embodiment to accomplish this, removable wear hubs may be stacked together as they are secured to the hub flange to obtain a desired thickness outside the plane of the side of the hub. Similarly, the removable wear hub may be made narrower such that when it is installed its face is inside the plane of the side of the spool. Also, as may be envisioned from this, different portions of the removable wear hub may be made of different thicknesses if desired so that some parts extend outwardly, some parts are flush with the side of the reel, and some parts are depressed from the plane of the side of the reel.

Figure 2C:
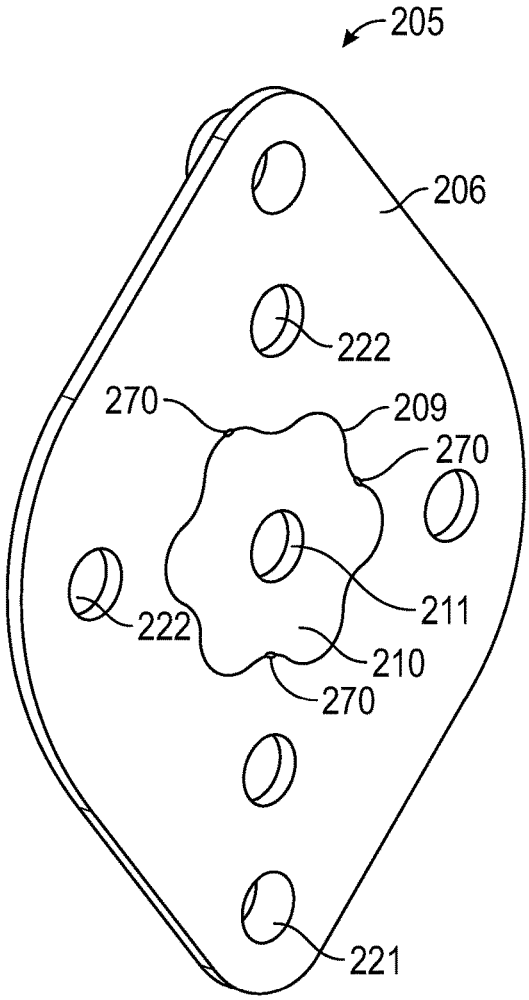
FIG. 2C illustrates an embodiment in which a splined hub is seated in a socket and secured therein with one or more welds.

The embodiment of FIG. 2A shows that the center of the removable wear hub 210 is concentric with the center of the hub, which may also be concentric with the center of the spool or reel. However, other embodiments consistent with the teachings herein may be envisioned where the pieces do not have concentric centers. As will be discussed in more detail below, FIG. 2A also illustrates a spline arrangement 268*a* and 268*b* as an example of a corresponding, predetermined shape between the replaceable hub 210 and the socket 209. FIG. 2C illustrates the splined hub 210 seated in the socket 209 and secured therein with one or more welds 270.

Figure 3A:
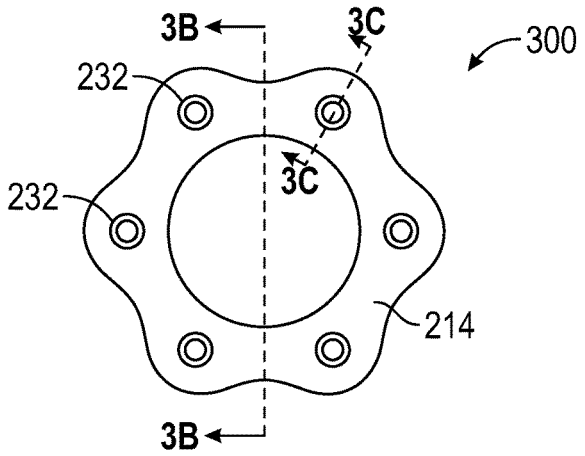
FIGS. 3A, 3B, and 3C illustrate detailed views of one of many exemplary removable wear hubs in accordance with certain teachings set forth herein.
Figure 3B:
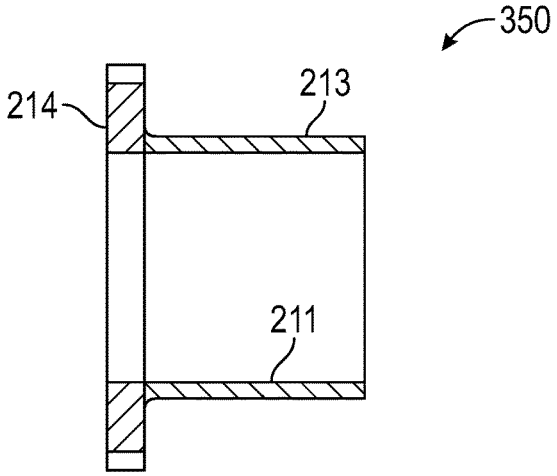
Figure 3C:
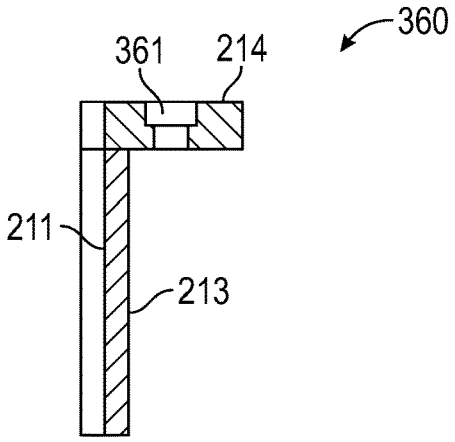

Different views of the removable wear hub 210 are also seen in FIGS. 3A, 3B, and 3C. FIG. 3B shows a cut-away view of the removable wear hub 210 depicting one embodiment where the axial sleeve collar 213 may be integral with the wear hub face plate 214. Alternately, the axial sleeve collar 213 may be welded to the bottom of the wear hub face plate 214 with a weld around the axial sleeve collar 213. While other methods to connect these pieces may be envisioned, if this embodiment is used, an allowance for that weld seam should be made within the space within the joint between the nut 212 and the bottom of the hub flange face plate 206.

In one of many possible embodiments, holes may be drilled through the wear hub face plate 214 of the removable wear hub 210 in a direction parallel with the central axis, that will match with, for example, threaded holes in the nut 212 at the bottom of the socket 209. In this way, threaded fasteners 233, such as bolts or studs, may be inserted through the wear hub face plate 214 and screwed into the nut 212 to secure the removable wear hub 210 to the hub flange 205.

FIG. 3C shows how concentric holes 361 may be drilled through the wear hub face plate 214 so that the tops of screws may be countersunk within the wear hub face plate 214 so they do not extend beyond the surface of the wear hub face plate 214. In some situations, it may be preferable to have the bolt be a hex-cap bolt and the clearance around it in the wear hub face plate 214 be sufficiently large to accommodate the use of a hex-cap bolt driver. In other situations, it may be preferable to have the bolt be a socket head bolt, which is more commonly known as an allen head bolt. In that case, the clearance around the head of the bolt may be kept very small since the socket head driver fits within the head of the bolt. While it may be advantageous to sink the heads of the bolts or screws so that they do not protrude beyond the face of the hub flange, there may be conditions where it is advantageous to use bolts where each of their bearing surfaces abuts the face of the hub and does protrude above the face of the central portion.

While screws, bolts, and cooperating threaded holes may be convenient and effective to use in this embodiment, those skilled in the art may envision many other methods of securing the described pieces together, such as with temporary rivets, temporary welds, the use of an interference fit, combinations of these, or any number of other methods known in the art.

Each of the components of the flange assembly, including the axial sleeve, the drive pin holes, and the lift holes, may be substituted with replaceable components consistent with the spirit of this invention. It will also be appreciated from the foregoing that the replaceable wear hub is desirably, but not necessarily secured to the drive flange and that relative rotation between the replaceable wear hub and drive flange be eliminated or minimized. These securing and torque transfer functions may be accomplished in several ways. In preferred embodiments, torque is transferred between the replaceable wear hub and drive flange by the predetermined and corresponding shape of the socket and wear hub, such as a spline, and, therefore, relative rotation there between is minimized or eliminated. Removable securing structures, such as threaded fasteners, weldments, and interference fits (also known as a press fit or a friction fit), can be used to secure the replaceable hub to the drive flange without the need for the removable securing structures to react torque, such as shear loads. Alternately, the removable securing structures, such as threaded fasteners, weldments, or an interference fit, can be used to both secure the replaceable hub to the drive flange and to transfer torque there between. In some situations, an interference fit and tack weld may be sufficient to transfer the drive forces from the drive motor to the spool or reel without the use of threadable fasteners. In such embodiments, the shape of the socket and replaceable wear hub can be circular or any shape.

In one envisioned embodiment of this invention, drive flange 205 will be assembled with a spool by way of a typical assembly process, such as welding. A person of ordinary skill in working with spools and reels would be able to insert and secure the removable wear hub 210 to the drive flange 205 and place the spool or reel into operation. In the course of use, the spool would be lifted by the lift holes 103 and settled into a reel assembly with an axle, bar, pin, spindles, or other suitable means through the axial sleeve 211 in the removable wear hub 210. The drive mechanism of a reel assembly would be engaged to the reel through the use of drive pins secured to the drive pin holes 222 in the drive flange 205. When the reel is no longer needed, it would be disengaged from the drive and hoisted out of the reel assembly. A person of ordinary skill in working with spools and reels would be able to examine the parts of the spool to determine if any part showed excessive wear. If excessive wear was noted on or in the axial sleeve 211, that person would be able to remove the removable wear hub 210, and replace it with another.

Figure 4:
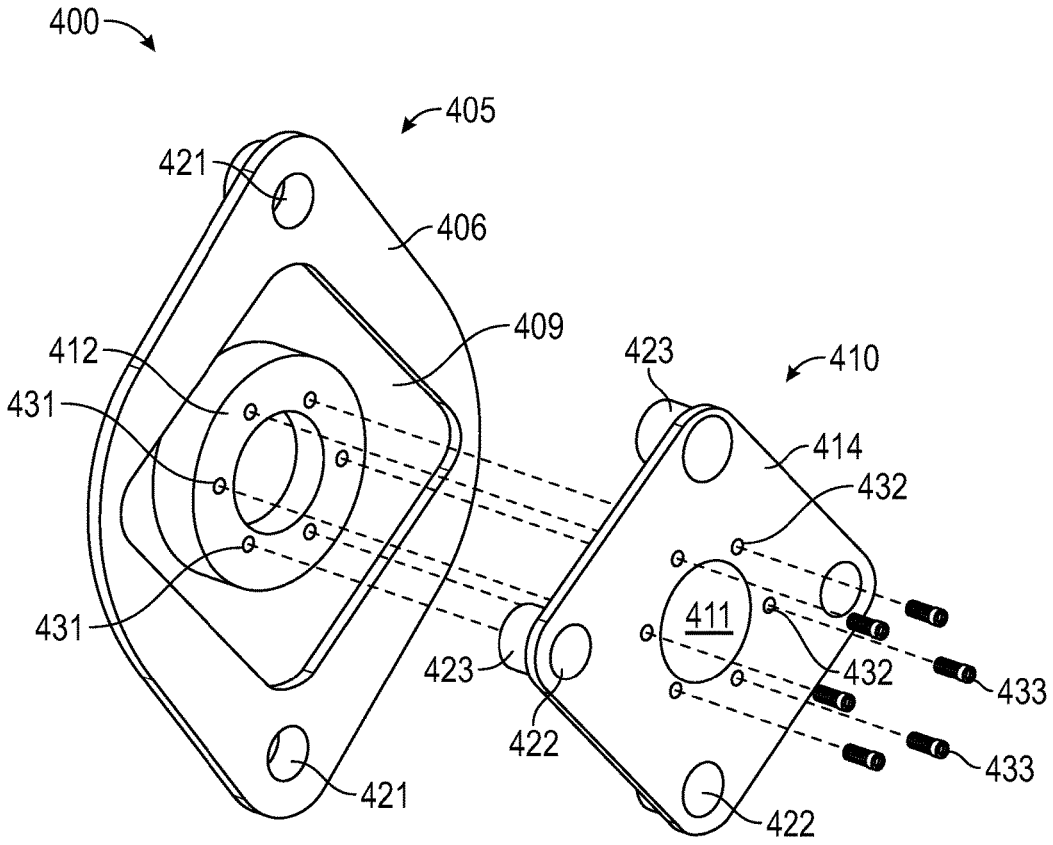
FIG. 4 illustrates an exploded view of another exemplary wear hub insertable into another exemplary hub flange in accordance with certain teachings set forth herein.

Turning now to another exemplary embodiment, FIG. 4 shows how a squarely shaped wear hub face plate 414 may be the replaceable wear hub 410 comprising the axial sleeve and an array of drive pin holes 422. In this illustrated embodiment, drive pin collars 423 may be secured to the back of wear hub face plate 414. This may be used to provide additional support for extending the wear of the drive pin holes 422. Other means may be utilized to do this as well, such as by using a fabrication method that results in a more hardened material, such as a bushing, around the drive pin hole than is throughout the other parts of the wear hub face plate. Those skilled in the art may utilize other fabrication or post-fabrication methods for producing a more durable hole in a wear hub face plate.

To accommodate the design of the wear hub face plate 414, a similarly shaped socket 409 will have to be made from the hub flange face plate 406. In this illustrated embodiment, the backing plate or nut 412 may be the same size as the bottom surface or nut 212 in the illustrated embodiment of FIG. 2. However, in that embodiment, nut 212 may be directly secured to the back of the hub flange face plate 206. A means for securing nut 412 into position in one possible embodiment may be accomplished by enlarging the nut and welding it to the hub flange face plate 406. However, in the embodiment illustrated in FIG. 4, the nut 412 may be secured to the proximal ends of the support members of the spool, which are not shown in this figure, but would be similar to the structural support members 106 in FIG. 1. The nut 412 itself may be a structural member within the drum when it is secured to the radial support members, or to other structural members, within the drum thereby making the entire spool more rigid. Similarly in this illustrated embodiment, drive flange 405 may be secured to the structural support members as well, with care being taken to ensure that nut 412 and the hub flange face plate 406 are properly aligned to receive the removable wear hub 410 so that threaded fasteners 433 fit in their respective holes 432 aligned with the threaded holes 431 in the nut 412.

It should be noted in this embodiment, as with all embodiments described in this specification, having a tight fit between the edges of the wear hub face plate 414 and the corresponding edges of the socket 409 in the hub flange face plate 406 may be an advantage of this invention. When the drive is engaged, the torque force of the drive pins will be transferred to the spool overall through the drive pin holes. If there is not a tight fit between the wear hub face plate 414 and the hub flange face plate 406, then the force will have to be transferred through the threaded fasteners 433. However, with a tight fit, the torque force may be transferred directly through the edges of wear hub face plate 414 and the hub flange face plate 406 cooperating with each other to react the force. From this, it can be seen that proper operation of the spool may still be achieved even in the unlikely event that all fasteners 433 fail. As was noted before, other methods of securing the replaceable wear hub with the hub flange are available. Utilizing any of them will not detract from the advantage of this invention of transferring torque applied to the replaceable wear hub to the hub flange and thus to the spool or reel overall for the purpose of rotation.

Figure 5:
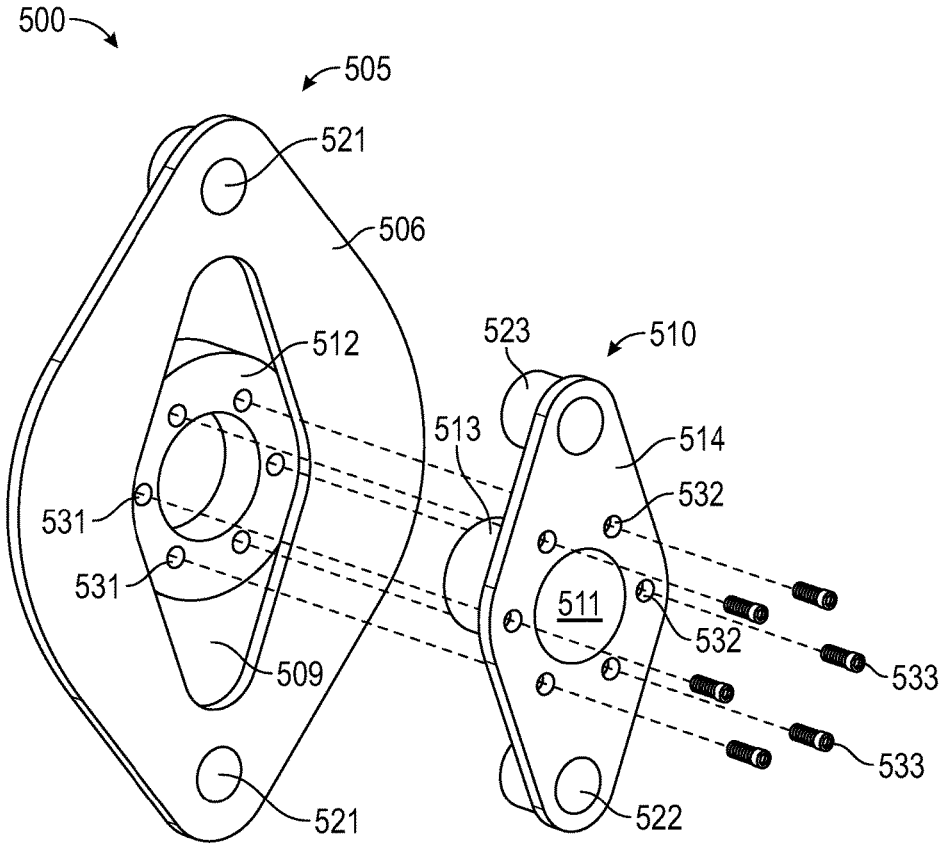
FIG. 5 illustrates an exploded view of another exemplary wear hub insertable into another exemplary hub flange in accordance with certain teachings set forth herein.

Turning now to another embodiment of this invention, FIG. 5 shows a rhombus (also known as a lozenge or diamond) shaped wear hub 514 with a cooperating socket 509 in drive flange 506. In this embodiment, the nut 512 may be in contact with the back of the hub flange face plate 506 and may be directly secured. This does not preclude the use of securing the bottom of the socket, backing plate, or nut 512 to the proximal ends of the spool support members as has been described; on the contrary, as has been noted such an attachment may provide additional stability and durability. Along this line, shafts have been installed in some prior art reels and spools to provide a continuous inside surface between the hubs. If one is desired in this, or in any of the other embodiments envisioned in this specification, a shaft may be installed by securing a hollow tubular member between the inside surfaces of the nuts on each hub. Those of ordinary skill in the art will be able to envision means and methods of making the inside diameter of the shaft through the spool or reel to be the same inside diameter of the axial sleeve if it is so desired, without departing from the spirit of this invention.

The embodiment depicted in FIG. 5 shows the axial sleeve 511 and the drive pin holes 522 as being on the removable wear hub 514. While this may be a desirable embodiment in many situations, other combinations of hub elements, or even comprising non-hub elements, may be envisioned through the teachings disclosed herein. As was noted before, protrusions from the plane of the face of the reel may disrupt the operations of the reel while it is being employed within a reel assembly. However, such protrusions may actually be advantageous when the reel is not in a reel assembly. In one of many embodiments that may take advantage of this, a padeye, hoist ring, hook, or any other device used for lifting may be part of a replaceable wear hub. When a reel is not in a reel assembly, the removable wear hub having an axial sleeve or drive pin hole may be removed, and a removable wear hub comprising a hoist ring inserted to allow it to be shifted. Then, when the reel is needed for service, a removable wear hub comprising the needed components may replace it.

In each of the illustrated embodiments shown in this disclosure, including FIG. 5, it should be noted that the area removed from the hub flange 506 to form the socket 509 does not contain any sharp angles. That is to say that the periphery shape of the socket is quadrilateral in that it is shaped as a rhombus but with rounded corners. This is done in accordance with generally acceptable engineering practices wherein it is more common for strain at sharp corners to fatigue the material faster. Avoiding the use of sharp corners will reduce the likelihood of strain-related fatigue at these points. However, there is nothing to prevent the practice of the inventions described herein from using a socket with sharp corners. In that, any non-circular shape used in these inventions may be any polygon with or without sharp vertices. The is the same as the outline of the socket 209 of FIG. 2 where the shape is a spline in that it is a sinusoidal curve around a point. It may be equally described herein as a regular polygon, a hexagram in this case, with rounded vertices. Similarly, the wear hub face plates may have rounded or sharp corners as long as they fit within the socket area with sufficient abutment to the edges of the hub flange to react forces imposed upon them.

In the embodiment shown in FIG. 5, there are only two drive pin holes 522 with accompanying drive pin collars 523 in the removable wear hub 510. The hub flange 505 comprises the lift holes 521 and the nut 512. This may be sufficient for a small spool or reel with lightweight tubing, pipe, or other spoolable or coilable material. This assembly may be preferred where there has historically been little to no wear on the lift holes while there has been sufficient wear or damage to the axial shaft and drive pin holes to warrant replacement in prior art reels and spools. In this embodiment, the method of replacing a removable wear hub may be the same as has been described previously. A practical consideration to this embodiment is when only a single component of the wear hub face plate 514 needs to be replaced, such as only a single drive pin hole 522. In that case, even though the remainder of the removable wear hub 510 is still serviceable, the entire component will need to be replaced. On the other hand, this may be preferable to replacing the entire reel or spool.

Figure 6:
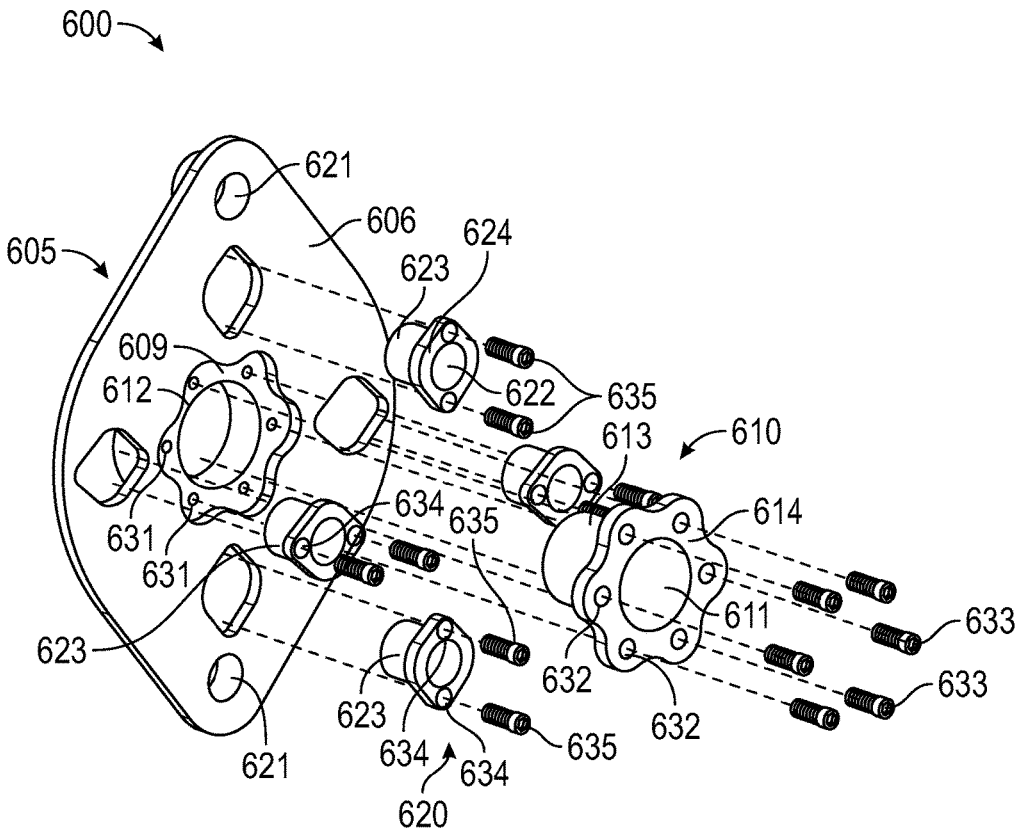
FIG. 6 illustrates an exploded view of multiple exemplary wear hubs insertable into another exemplary hub flange in accordance with certain teachings set forth herein.

Turning now to another embodiment of this invention, FIG. 6 shows a fully modular assembly wherein several individual components of the drive flange may be individually replaced. The removable central wear hub 610 has an outward spline shape with holes 632 in the face plate 614 by which it may be secured to the nut 612 in the hub flange 605. This portion is similar to that depicted in FIG. 2. Radially outward from the center are the drive pin holes. In this embodiment replaceable drive pin wear hubs 620 are utilized rather than simple holes in the hub flange 605. These comprise the drive pin hole 622, and drive pin hole collar 623, and drive pin hole face plate 624. The drive pin hole face plate 624 for each unit has holes 634 through which threadable fasteners 635 may be utilized to secure each replaceable drive pin wear hub 620 into position. These replaceable drive pin hole wear hubs 620 may be secured to a nut (not shown) behind the hub flange 605, or may be secured directly to the tubular support members. The drive pin hole face plates 624 are oval shaped in this embodiment. However, these may be shaped or secured in place in any manner that will react a load against the hub flange face plate 606. As may be seen from this, each replaceable wear hub may be individually replaced as needed.

In another envisioned embodiment, all of the drive pin holes may be arranged on a single replaceable wear hub that may be replaced as a unit. These may be arranged on a ring, or arranged on a form that has edges cooperating with the edges of hub flange to transfer torque when force is applied. Such an embodiment would allow the central wear hub to be replaced as a unit separate from the replacement of all of the drive pin holes. In this envisioned embodiment, there may be two hub flanges, each acting as a drive member. The inner, circular hub flange may comprise an axial sleeve, and a hub flange radially outwards from the ring of drive pin holes on a wear hub comprising lift holes. In a similar embodiment, pairs of drive pin holes may be on the same replaceable wear hub. Other embodiments may be envisioned where multiple hub flanges may be useful without departing from the spirit of this invention.

As has been described throughout this specification, suitable replaceable wear hubs may substitute the functional components of the hub of a reel or spool. However, having a replaceable wear hub enables additional features to this invention. As was noted earlier, idle reels and spools may be subject to the elements. And, even when reels and spools are in active use, the lift holes may be exposed to rain, dust, and grit, which may facilitate corrosion. Therefore, it is another envisioned embodiment of these inventions to replace a replaceable wear hub with a blank face plate. An example of the practicability of this would be in the case where a spool is being transported. In that case, the drive pin holes would be unused but exposed. Replacing the removable drive pin hole wear hubs with blank face plates would prevent those replaceable wear hubs from being exposed to the weather. When the spool reaches its destination and is ready for service, the replaceable drive pin hole wear hub may be substituted for the blank face plates. In this embodiment, the blank face plates may be made of material that is not as resilient to wear as a replaceable wear hub, to reduce its cost. With that being said, the edge of the hub flange should be protected from damage so that it may react the forces for rotation of the drum. One of many ways to accomplish that may be to have an overlapping cover outside of the blank face plate which will protect the edges. This may be a separate plate that is secured over the blank face plate, or it may be a separate unit comprising a portion that fits in the opening along with a portion that overlaps the opening above the face of the hub flange.

Another practicable feature of these inventions may be enabled through the use of blank face plates and removable wear hubs. As was noted before, the drive motor may be located on one side of many reel assemblies. However, drive pin holes have typically been placed on both sides of reels and spools. From that, if the drive pin holes on one side of a reel or spool are damaged, the reel or spool may be reversed so that undamaged drive pin holes are on the same side of the assembly as the drive motor. However, even with this flexibility, unused drive pin holes may be exposed to the elements and may be susceptible to corrosion when not in use. Therefore it may be desirable to have a hub flange on one side of the reel or spool with a removable wear hub comprising drive pin holes, and a hub flange on the other side without drive pin holes. This will allow worn or damaged drive pin holes to be replaced on one side only, without having unneeded drive pin holes needlessly exposed to the elements on the other side. It may be envisioned that both hubs on a spool or reel have identical or substantially identical periphery shapes to receive removable wear hubs. In that case, a removable wear hub with the drive pin holes may be swapped with a similar removable wear hub that does not have drive pin holes if it becomes advantageous to have the drive pin holes on one side rather than the other. In accordance with certain teachings set forth herein, other embodiments of removable wear hubs comprising or omitting certain parts working in tandem on cooperating hubs may be envisioned.

In some cases, spindles are inserted into reels at the jobsite. This allows a reel to be manufactured and transported without a spindle protruding from its side. Protruding spindles may cause problems when spools or reels are transported in that they may be jarred causing damage to the side of the spindle, or they may be wider than desired to optimally fit on a truck, train, or ship. However, even the act of inserting a spindle into an axial sleeve in the field may cause damage. Therefore, it is another envisioned embodiment of this invention that the central removable wear hub comprise a spindle protruding from one side of the face plate. When it is secured to the hub flange with the spindle facing outward, it will act in exactly the same way as an inserted spindle would act. Then, when it is no longer needed, the face plate may be reversed so that the spindle resides within the drum of the reel. This will preserve the spindle from damage while it is not needed yet be available by having a technician ordinarily skilled in the art of reels and spools reverse the removable central wear hub. As may be envisioned this may be performed when the removable wear hub has a symmetrically reversible shape.

In some situations when the material coiled on a spool is needed in the field, an elongate member, such as a spare piece of rigid pipe or angle bar, may be inserted through the central shaft of the spool and the protruding ends of the rigid pipe or angle bar may be supported on cradles and the material directly payed off without the use of a drive to rotate the spool. This method may damage the coiled material by placing too much tensile force upon it since a greater pulling force may be required to pay off the spooled material in order to overcome both the friction between the central shaft of the spool and the improvised axle, and the resting momentum of the spool. Placing resistance reducing mechanisms into the hub, such as roller bearings or other types of shaft bearings have frequently been too costly to place into spools on a permanent basis. However, placing a removable shaft bearing into the central shaft of a spool may be enabled in accordance with certain teachings contained herein. As was noted earlier, those skilled in the art will be able to develop a central shaft of consistent diameter between the hubs including the axial sleeves of the replaceable wear hubs. Those similarly skilled and knowledgeable in the inventions described herein will be able to modify the axial sleeve so that a rolling-element bearing may be retained between the inside of the replaceable wear hub face plate and a nut so modified as to accept some type of rolling-element bearing. Therefore, having a rolling-element bearing, or similar friction reducing assembly, within the central shaft of a spool will reduce the amount of force needed to directly pull coiled material from the spool. Also, since the replaceable wear hubs may be removed and replaced, relatively expensive rolling-element bearings may be removed from spools that are not in use. Those ordinarily skilled in the art will be able to recognize that rolling-element bearings comprise many types of bearings such as roller bearings and ball bearings, and that journal bearings, as well as other types of friction reducing mechanisms may be used in this exemplary system as well.

A full axle with appropriate extensions may be retained within the central axial shaft as well with another envisioned embodiment of the inventions disclosed herein. In one of many ways to describe this, an axle may be constructed such that it has shoulders near each end, which are of a larger diameter than the axial sleeve of a removable wear hub. When needed, one removable wear hub may be taken off of one hub and the axle inserted into the central shaft. The shoulder of the axle may be restrained from passing through the axial sleeve on the other side because of the greater diameter of the shoulder, but still with the distal end of the axle extending beyond the hub. The near removable wear hub may then be replaced allowing the proximal end of the axle to extend beyond the near removable wear hub. When the axle is no longer needed, the process may be reversed to withdraw the axle from the central shaft. Combinations of axles and rolling-element bearings in accordance with certain teachings contained herein may be envisioned by those familiar with the inventions disclosed herein as well. In one of many possible embodiments, roller bearings may be permanently attached to an axle and may act as the shoulders, which may be retained within the central axial shaft by the axial sleeves or similar elements within the replaceable wear hubs. In yet another of many possible embodiments of the inventions disclosed herein, the ends of the axle may be retractable within the central shaft of the spool such that the ends of the axle are withdrawn into the central shaft of the spool when they are not needed, and may be extended when the spool is needed for use.

In many cases, the size of the drum of a spool or reel may be influenced by a characteristic of the material being coiled upon it. As an example, fiber optic cable has a core made of material that will fracture if it is bent beyond a specific arc, commonly known as the bend radius. Therefore, a spool or reel will be chosen for fiber optic cable that has a drum radius greater than the bend radius of the fiber optic cable to be wound upon it. Some spoolable materials have very large bend radii necessitating very large drums. In those cases, there may be a large amount of relatively empty space within the drum between the hubs. This space may be put to use enabling certain teachings set forth herein. The empty space may be used to house spare replaceable wear hubs so they would be immediately available for replacement if needed. One of many possible envisioned embodiments would be to form a compartment within the drum accessible from a hub. This compartment may be sealed by placing a blank cover plate as previously described over the compartment opening. Spare removable wear hubs specifically made for that hub flange may be placed within a compartment and retained there by the blank cover plate. When a spare part is needed, the compartment would be opened by removing the blank cover plate, and the spare part removed.

Other and further embodiments utilizing one or more aspects of the inventions described above can be devised without departing from the spirit of my invention. For example, while there may be advantages to having the periphery shape of the hub flange fit uniformly with the periphery shape of the removable wear hub face plate, it does not always need to be such. As an example, it may be envisioned that the periphery shape of the hub be that of a hexagram while the removable wear hub face plate shape be that of a triangle. In this embodiment, the three radial protrusions of the triangle would fit within three areas of the hexagram, leaving three unfilled areas of the hexagram. Further, the various methods and embodiments of the methods of manufacture and assembly of the system, as well as location specifications, can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by me, but rather, in conformity with the patent laws, I intend to fully protect all such modifications and improvements that come within the scope or range of equivalent of the following claims.

What is claimed is:

1. A spool comprising:

a pair of sides;

a drum extending between the sides and centered substantially about an axis of spool rotation;

a flange associated with at least one side and comprising an outer face, and comprising a hub socket centered substantially about the axis of spool rotation and having a non-circular predetermined shape;

a replaceable hub configured to support rotation of the spool about the axis of rotation, configured to mate with the hub socket and configured so that when the hub resides in the hub socket an outer hub face and the flange outer face are substantially flush; and an anti-rotation structure operable between the replaceable hub and the flange and configured to prevent rotation between the flange and the replaceable hub.

2. The spool of claim 1, wherein the anti-rotation structure is the shape of the hub socket and the replaceable hub.

3. The spool of claim 2, wherein the replaceable hub is secured to the flange with threaded fasteners.

4. The spool of claim 3, wherein the threaded fasteners react axial loading and react little to no shear loading.

5. The spool of claim 2, wherein the anti-rotation structure is splines.

6. The spool of claim 2 wherein the anti-rotation structure is a polygon.

7. The spool of claim 1 wherein the replaceable hub is secured to the flange with an interference fit.

8. The spool of claim 1 wherein the removable hub is removably secured to the flange with one or more welds.

9. The spool of claim 1, wherein the replaceable hub also comprises at least one drive component configured to operably engage a drive system for providing rotation to the spool.

10. The spool of claim 9, wherein the at least one drive component is a drive pin hole.

11. The spool of claim 1, wherein the flange further comprises one or more drive sockets displaced from the axis of rotation and a replaceable drive component configured to reside in the drive socket.

12. A method of rehabilitating the spool of claim 1 comprising:

removing any structure securing the replaceable hub to the flange;

withdrawing the replaceable hub from the socket; and inserting a replacement hub into the socket.

13. A spool comprising:

a first side component comprising a central portion;

a second side component comprising a central portion;

a drum disposed between the central portions of the first and second side components and centered substantially about an axis of spool rotation;

each central portion comprising an outer face and a hub socket centered substantially about the axis of spool rotation, the socket having a non-circular predetermined shape;

a replaceable hub associated with each central portion and configured to support rotation of the spool about the axis of rotation, each hub configured to mate with its associated hub socket and each hub configured so that when the hub resides in the hub socket an outer hub face and the central portion outer face are substantially flush;

a torque transfer structure operable between the replaceable hub and the central portion and configured to transfer torque between the central portion and the replaceable hub; and at least one securing device for each hub configured to removably secure the hub in the socket.

14. The spool of claim 13, wherein the torque transfer structure is the predetermined shape of the socket and hub.

15. The spool of claim 13, wherein at least one of the replaceable hubs also comprises at least one drive portion.

16. The spool of claim 13, wherein at least one of the central portions also comprises at least one replaceable drive portion.

17. A spool comprising:

a pair of sides;

a drum extending between the sides and centered substantially about an axis of spool rotation;

a flange associated with at least one side and comprising an outer face and a hub socket centered substantially about an axis of spool rotation and having a predetermined circumferential shape other than a circle;

a replaceable hub configured to support rotation of the spool about the axis of spool rotation, configured to mate with the hub socket and configured so that when the hub resides in the hub socket an outer hub face and the flange outer face are substantially flush; and wherein rotation of the spool is transferred through the abutting surfaces of the hub and the flange.

18. The spool of claim 17, wherein at least one of the replaceable hubs also comprises at least one drive portion.

19. The spool of claim 17, wherein the replaceable hub is secured to the spool with threaded fasteners.

20. The spool of claim 17, wherein the replaceable hub does not abut all surfaces of the predetermined shape.

21. A spool comprising:

a pair of sides;

a drum extending between the sides and centered substantially about an axis of spool rotation;

a flange associated with at least one side and comprising an outer face, and comprising a hub socket centered substantially about the axis of spool rotation and having a non-circular predetermined shape;

a replaceable hub configured to support rotation of the spool about the axis of rotation, configured to mate with the hub socket, configured so that when the hub resides in the hub socket an outer hub face and the flange outer face are substantially flush, and secured to the flange with one or more threaded fasteners; and an anti-rotation structure operable between the replaceable hub and the flange and configured to prevent rotation between the flange and the replaceable hub.

22. The spool of claim 21, wherein an outer surface of the at least one threaded fastener does extend beyond the our face of the flange.

23. A spool comprising:

a pair of sides;

a drum extending between the sides and centered substantially about an axis of spool rotation;

a flange associated with at least one side and comprising an outer face and a hub socket centered substantially about an axis of spool rotation and having a predetermined shape;

a replaceable hub configured to support rotation of the spool about the axis of spool rotation, configured to mate with the hub socket, configured so that when the hub resides in the hub socket an outer hub face and the flange outer face are substantially flush, and secured to the flange with one or more threaded fasteners; and wherein rotation of the spool is transferred through the abutting surfaces of the hub and the flange.

24. The spool of claim 23, wherein an outer surface of the at least one threaded fastener does extend beyond the outer face of the flange.

* * * * *